United States Patent [19]

Johnson

[11] 4,048,369

[45] Sept. 13, 1977

[54] METHOD FOR CONTROLLING ALLERGENS

[76] Inventor: Charles E. Johnson, 5250-19L S. Cherry Creek Drive, Denver, Colo. 80222

[21] Appl. No.: 640,206

[22] Filed: Dec. 12, 1975

[51] Int. Cl.[2] ..... B05D 7/24; B32B 27/12

[52] U.S. Cl. ..... 428/262; 428/264; 428/265

[58] Field of Search ..... 427/390 R, 390 E; 428/262, 264, 265

[56] References Cited

U.S. PATENT DOCUMENTS

| | | | |
|---|---|---|---|
| 2,530,792 | 11/1950 | Stewart et al. | 428/264 |
| 3,476,581 | 11/1969 | Weitzel et al. | 428/264 X |

*Primary Examiner*—James R. Hoffman

*Attorney, Agent, or Firm*—A. W. Breiner

[57] ABSTRACT

A composition of matter suitable for controlling allergens in fabrics comprising an aqueous film forming solution having a pH from between about 7 and 10 wherein the resulting film:

a. has a minimum film forming temperature (MFT) below about 30° C, b. contains polymers having a glass transition temperature (Tg) less than about 20° C, and c. is hydrophobic, substantially non-nutritive, flexible, continuous, and autosoluble.

Repetitive application of these coatings to certain fabrics in a household has been found to substantially reduce the activity of pyroglyphid mites and their debris with a corresponding reduction in the allergy potential of these fabrics.

4 Claims, No Drawings

METHOD FOR CONTROLLING ALLERGENS

BACKGROUND OF THE INVENTION

Dust in the home or "house dust", is the source of troublesome symptoms of allergy for an unknown number of people who may be constantly bothered by sneezing and a runny nose or by wheezing and shortness of breath. The possible harmful effects of house dust have been recognized for some time. More recently, the dust fauna, in particular arthropods such as, pyroglyphid mites and their debris received attention in relation to house dust atopy, an important factor in the etiology of bronchial asthma and rhinitis. The symptoms that result from allergy to house dust are usually those of perennial allergic rhinitis, sneezing, runny nose or nasal obstruction, and watery itching eyes. These may be identical to symptoms associated with seasonal hay fever.

Current literature surveys indicate that no recommendations can be given for control of house dust mites. Neither chemical nor sanitary controls are deemed possible due to the lack of knowledge in this field. Moreover, it has been established that most acaracides had little effect at concentrations under 1% which in most instances is too severe a treatment to be used in the household on known areas of high mite density such as, bedding, upholstery, etc. where humans are constantly exposed. Moreover, these treatments did not control mite debris a known allergen.

OBJECTS OF THE INVENTION

Therefore an object of the present invention is to control the allergens found in house dust.

Another object of the invention is to provide a composition for controlling allergens found in fabrics and this composition is suitable for use around humans.

A further object of the invention is to control the debris of pyroglyphids found in fabrics.

Still another object of the invention is to treat fabrics to restrict the mobility of mites, and mite debris, maintain a low moisture environment around mites and isolate mites from critical nutrients.

These and other objects of the invention will be apparent from the following description and claims.

SUMMARY OF THE INVENTION

The link between pyroglyphid mites, allergy and house dust now suggests that allergy relief can be obtained in a typical household environment by altering the micronenvironment of these mites in those specific areas of the household which would have the most significant effect on controlling mite activity. Moreover, such an alteration of the mites microenvironment can be achieved in a manner which is compatible with exposure of humans.

It has been established that certain areas of a typical household which are characterized by a predominane of fabric being present such as upholstered furniture, bedding, mattresses and carpeting provide ideal host microenvironments for pyroglyphid mites. It has now been found that if these fabrics are periodically coated with a substantially continuous, autosoluble, flexible film having certain physical properties, that the pyroglyphid mite activity on and in these fabrics can be controlled with a corresponding reduction in the allergy potential of these fabrics.

Controlling mite activity includes controlling the biological as well as physical activity of the mite and its debris which includes its chitinous exoskeleton and excrement.

It has been found that controlling the activity of mites can best be achieved by altering the microenvironment of certain fabrics traditionally high in mite density with a coating composition which tends to isolate the mites and/or their exoskeleton and excrement. It has also been found that this type of control reduces allergic responses significantly. In addition, if an appropriate substance is selected to isolate mites and their debris certain other critical environmental factors such as moisture level and nutrient availability can also be altered which will further control the activity of the mite.

Mite nutrients include human scale, dander, dust fibers, and food particles. The isolation of mites from these critical nutrients is achieved by coating certain fabrics found in a household where mites tend to live and reproduce. This coating forms a barrier on the fabric between the mites present and fugitive nutrients which tend to collect on these fabrics after treatment.

Thus, optimum substances for controlling mite activity include coating compositions which, a. restrict the mobility of mites and mite debris,
b. maintain a reduced moisture environment around the mite, and
c. isolate and/or encumber the mite from critical nutrients.

These and discussed in detail below.

The compositions of the invention are suitable for controlling allergens in fabrics and comprise an aqueous film forming solution having a pH from between about 7 and 10 wherein the resulting film;

a. has a minimum film forming temperature (MFT) below about 30° C,
b. contains polymers having a glass transition temperature (Tg) less than about 20° C, and
c. is hydrophobic, substantially non-nutritive, flexible, continuous, and autosoluble.

Repetitive applications of these coatings to certain fabrics in a household has been found to substantially reduce the activity of pyroglyphid mites and their debris with a corresponding reduction in the allergy potential of these fabrics.

COATING COMPOSITION

The present invention teaches controlling allergens by periodically coating various fabrics with an aqueous film forming solution having a pH from between about 7 and 10 wherein the resulting film:

a. has a minimum film forming temperature (MFT) below about 30° C, and
b. contains polymers having a glass transition temperature (Tg) less than about 20° C.

These aqueous film forming solutions are applied to the entire fabric surface and wet out the fabric. When the water evaporates a continuous polymeric film coats the fabric. It is critical for the purposes of the present invention that these coatings be applied to the substrate in the form of a solution in order to thoroughly coat the fabric with the continuous, flexible, non-nutritive film. A typical problem encountered is that the fabric surface to be treated is not coated completely and "hot spots" of pyroglyphid mite activity are found to exist after treatment.

The films of this invention can be generally described as:

a. hydrophobic,
b. substantially non-nutritive to pyroglyphid mites,
c. flexible,
d. continuous, and
e. autosoluble.

The coating compositions of the invention are only effective as long as the dust mite and its debris are immobilized and the mite is maintained under less than optimum growth conditions. For example, it is critical to the present invention that the film applied to various fabrics be non-nutritive. That is, the film itself should not provide nutrition to the dust mite.

It has been found critical to controlling the activity of pyroglyphid mites in fabrics that the film be autosoluble. That is, according to the present invention the films of the invention can be redissolved when a second coating composition of the invention is applied to the fabric. This autosolubility property is a function of the pH of the coating composition and the alkali solubility of the polymer.

The coating compositions of the invention produce flexible films which are substantive to the various fabrics treated. Generally these films are from between about 0.01 and about 1 micron in thickness. In a preferred embodiment of the invention these films are from between about 0.1 and about 0.5 mils thick. These films have an MFT of less than about 30° C. That is, these continuous films are formed at ambient conditions irrespective of the method used to apply them, provided the fabric surface is totally wetted.

RESTRICTION OF MITE AND MITE DEBRIS MOBILITY

The association of pyroglyphids with house dust allergy has been well documented. However, it is yet to be determined in what way mites are related to allergenic factors. There are three systems by which products from mites are thought to be deposited in house dust and in each of these systems the debris is readily mobile and tends to become airborne itself or as a part of a dust fiber. These systems are:

1. The integumentary system contributes shed cuticle, molting fluids and glands with their secretions;
2. The reproductive system produces eggs, seminal fluid and probably accessory materials from egg laying and copulation; and
3. The digestive-excretory system contributes faecal material with a variety of components, and a gut lining very much like a peritrophic membrane.

Thus, it can be appreciated that the control of this mite debris is achieved in the present invention by the application of the coating compositions of the invention which entrapps the debris in the fabric and reduces debris mobility.

It can be appreciated that the coating compositions produce a film that is substantially continuous in order to hold the debris in the fabric. Further, the coatings of the invention must be flexible in order to maintain their continuity when the fabric is flexed. The net effect of treating fabrics infested with mites and debris with the coating compositions of the invention is the reduction of live mites in the fabric. Secondarily, these coated fabrics are substantially impenetrable towards mites which may attempt to reinfest the fabric and thus the fabric surface is no longer a microenvironment ideally supportive of mite activity and the mites will tend to seek other host environment.

MAINTAINING REDUCED MOISTURE ENVIRONMENT

The population growth of pyroglyphids is closely related to the absolute humidity of the indoor and outdoor air; almost every change in humidity is followed by a change in mite numbers and mite activity.

It has been established that standardized femal North American house dust mites maintain a constant equilibrium water mass, independent of ambient water vapor activities above the critical equilibrium activity (CEA = 0.70 at 25° C). When confined to water vapor activities below the CEA, transpiration rate is greater than sorption rate and a net water loss is incurred for an increment of time.

Further, it has been established that the rate of water loss for mites held at dehydrating conditions is inversely proportional to the water vapor activity of the air. For example, for test water vapor activities of 0.525, 0.225 and 0.00 the rate of water loss is respectively 1.11, 1.40 and 1.77% $hr^{-1}$ at 25° C. Mean survival time at these dehydrating activities is 69, 55 and 43 hrs. respectively. Standardized females are 81% water by weight and tolerate water loss up to 46.5% before death occurs.

Thus, it can be appreciated that coating fabrics having high mite density with the compositions of the present invention can effectively control the mites microenvironment and reduce mite populations. This control is attributed at least in part to the hydrophobic nature of these continuous, flexible films. These coatings produce films that upon air drying have low water tension. These films tend to retain a moisture level less than required for mite subsistence i.e. a CEA of less than 0.7 at 25° C. This results in an environment that is antagonistic to mite activity.

ISOLATE MITES FROM CRITICAL NUTRIENTS

House dust mites prefer nutrients such as human skin scales, dandruff, dry hair, vegetable fibers including lint, yeast and gelatin. Coating fabrics where mites tend to collect with the coating compositions of the invention has been observed to restrict the availability of such nutrients to the mites. Moreover, since the coating composition itself is not a nutrient for the mite these coating compositions tend to control the activity of mites by starving them.

THE POLYMER

The polymers suitable for the coating compositions of the invention can generally be described as alkali soluble, having a Tg of less than about 20° C and capable of forming a film at less than 30° C. Generally the preferred polymers of the invention will have relatively low molecular weights.

These polymers are comprised of carboxylic acid containing monomers and monomers containing a vinyl group. These polymers contain monomers which are further described as acid monomers, soft monomers, and optionally hydrophobic monomers.

Soft monomers are those monomers which produce flexible homopolymers having a brittle point below about 20° C. Preferred soft monomers are vinyl acetate; the alkyl esters of acrylic acid wherein said alkyl group contains from 1–12 carbon atoms (such as methyl acrylate, ethyl acrylate, butyl acrylate, hexyl acrylate, 2-ethylhexyl acrylate and lauryl acrylate); and the higher alkyl esters of methacrylic acid wherein said higher alkyl group contains from 4–12 carbon atoms (such as butyl methacrylate, 2-ethylhexyl methacrylate and lauryl methacrylate). The preferred soft monomers are ethyl acrylate and butyl acrylate.

The acid monomers are monoethylenicaly unsaturated compounds having at least one, and preferably only one, carboxylic acid group. Examples of these monomers include acrylic, methacrylic, itaconic, maleic and crotonic acids; monoalkyl esters of itaconic and maleic acids wherein said alkyl group contains 1–8 carbon atoms (e.g., methyl, ethyl, butyl, hexyl, and octyl). The preferred acid monomers are acrylic and methacrylic acids.

Suitable hydrophobic monomers which can be included in the acrylic polymer are the lower alkyl methacrylates wherein said lower alkyl group contains 1–3 carbon atoms (such as methyl methacrylate, ethyl methacrylate and isopropyl methacrylate); cycloalkyl acrylates and methacrylates wherein said cycloalkyl group contains 5–7 carbon atoms (such as cyclohexyl acrylate and cyclohexyl methacrylate); and hard vinyl monomers such as styrene. The preferred hydrophobic monomers are styrene and the lower alkyl methacrylates, particularly methyl methacrylate.

Listed in Table I below are examples of preferred alkali soluble polymers useful in the coating compositions of the invention. The composition of the polymers is described in weight percent of the monomers present. In addition, the glass transition temperature Tg of these polymers is shown. It should be understood that the Tg range from −9° C to 14° C defines polymers that produce flexible films which would not tend to fracture upon flexing of the substrate.

TABLE I

| | MONOMER CONTENT WEIGHT PERCENT | | | | | |
|---|---|---|---|---|---|---|
| EX. | EA(1) | MMA(2) | nBuA(3) | MAA(4) | AA(5) | Tg° C |
| 1 | 63 | 22 | — | — | 15 | 14 |
| 2 | 72 | 18 | — | 10 | — | 8 |
| 3 | 80 | — | — | — | 20 | −4 |
| 4 | — | — | 60 | 40 | — | 3 |
| 5 | — | — | 60 | — | 40 | −9 |

(1)EA = Ethyl Acrylate
(2)MMA = Methyl Methacrylate
(3)nBuA = Normal Butyl Acrylate
(4)MAA = Methacrylic Acid
(5)AA = Acrylic Acid The preferred polymers for the coating compositions of the invention are generally produced by addition emulsion polymerization. For example, for each 100 parts of monomer used 3 parts of a surfactant such as sodium lauryl sulfate and 0.5 parts of an initiator such as ammonium persulfate are mixed with 300 parts of distilled water. This emulsion polymerization is carried out by heating the sodium lauryl sulfate in water to 80° C under an inert gas blanket in a reactor equipped with a stirring mechanism. The ammonium persulfate is first added and then the blend of monomers is slowly added to the aqueous mixture over a period of 1 hour. The reaction mixture is then maintained at reaction temperature for one hour and then cooled. The pH of the alkali soluble emulsion polymer is adjusted to the 7 – 10 region with an ammonium hydroxide solution and stirring. The final mixture is an autosoluble film forming solution.

APPLICATION OF THE COATING

It has been established that arthropods such as pyroglyphid mites have a peak growth period which occurs annually depending on the climate. For example, in temperate moist climates the peak growth period for these mites extends from July to October. In addition, it has been observed that there is a high correlation between maximum indoor moisture level and living mites present during peak growth periods.

It has now been found that if certain optimum mite host fabrics found in households are treated with the compositions of the present invention prior to such peak growth periods mite populations and debris populations will be substantially reduced and the allergy potential of these fabrics is correspondingly reduced. Thus, as described in Table II certain critical fabrics found in a household are selectively treated at least once annually prior to the peak growth to control mite activity and to avoid reinfestation of mites.

There are certain areas of the typical household that are more supportive of mite activity than others. These include: mattresses, bedding, upholstered furniture, and carpeting.

The dense mite populations common to mattresses is attributed in part to the excessive amount of human scale and plant fibers present which are known preferred nutrients for mites. In addition, the mattress is considered to provide the optimum constant moisture level available in most households. Mites are found to live in the surface layer of the mattress.

It can be understood why mattresses are considered the reservoir of pyroglyphid mite activity in most households and the source for mite reinfestation throughout the household. A preferred area of treatment for the present invention is the entire mattress surface and bedding.

The following examples are given to illustrate embodiments of the invention as it is presently preferred to practice it. It will be understood that these examples are illustrative and the invention is not to be considered restricted thereto except as indicated in the appended claims.

EXAMPLES 6 – 9

Various coating compositions are described in Table II below for application to various fabric substrates using various application techniques. These coatings produce films which are hydrophobic, substantially non-nutritive, flexible, continuous and autosoluble.

It will be apparent from the following examples that various coatings can be applied to a variety of fabrics in order to control mite activity. It can be appreciated from these examples that a system of mite control could be developed for a typical household, such a system would require routine treatment of some surfaces and less frequent treatment of others.

It is expected that if these treatments were maintained consistently on all critical fabrics in a household that mite activity in a household could be reduced substantially.

TABLE II

| EX. NO. | COATING COMPOSITION POLYMER TYPE | POLYMER WEIGHT % | AMOUNT OF WATER WT. % | FILM pH | FILM MFT ° C | APPLICATION SURFACE | AMOUNT gm/sq.ft. | METHOD | FREQUENCY |
|---|---|---|---|---|---|---|---|---|---|
| 6 | Ex 1 | 10 | 90 | 8 | 14 | Mattress | 10 | Sponge | 6–12 mo. |
| 7 | Ex 2 | 1 | 99 | 9 | 8 | Bedding | — | Dipping | After each laundering |
| 8 | Ex 3 | 20 | 80 | 9.5 | −4 | Upholstery | 5 | Pump Spray | 6–12 mo. |
| 9 | Ex 4 | 4 | 96 | 9 | 3 | Carpet | 50 | Sponge Mop | 6 mo. |

It is claimed:

1. A method of controlling pyroglyphid mite activity in fabrics comprising coating the fabric with an aqueous film forming solution having a pH from between about 7 and 10 to produce a film having a MFT below about 30° C, said film containing a major amount of a polymer having a Tg less than about 20° C wherein the film is hydrophobic, substantially non-nutritive, flexible, continuous and autosoluble.

2. The method according to claim 1 wherein said film is from between about 0.01 and about 1 mil in thickness.

3. The method according to claim 1 wherein said film retains a moisture level less than the critical equilibrium activity of 0.7 at 25° C.

4. The method according to claim 1 wherein the entire surface of the fabric is wetted out with said coating.

* * * * *